US005544438A

United States Patent [19]

Fazekas

[11] Patent Number: 5,544,438

[45] Date of Patent: Aug. 13, 1996

[54] CARD AND PICTURE HOLDER

[76] Inventor: James I. Fazekas, 8820 W. 174th St., Tinley Park, Ill. 60477

[21] Appl. No.: 415,449

[22] Filed: Apr. 3, 1995

[51] Int. Cl.[6] ..... G09F 7/00

[52] U.S. Cl. ..... 40/605; 40/729; 40/730; 40/731; 40/733; 40/781; 403/65; 16/366; 160/229.1

[58] Field of Search ..... 40/605, 729, 730, 40/731, 733, 781; 403/65; 16/366; 160/135, 229.1, 236

[56] References Cited

U.S. PATENT DOCUMENTS

| | | | |
|---|---|---|---|
| 3,673,724 | 7/1972 | Bell et al. . | |
| 4,017,989 | 4/1977 | Murray . | |
| 4,115,938 | 9/1978 | Belmuth et al. . | |
| 4,145,827 | 3/1979 | Katsufrakis . | |
| 4,271,618 | 6/1981 | Lyman | 40/781 X |
| 4,385,459 | 5/1983 | McGrath et al. . | |
| 4,608,770 | 9/1986 | Gray . | |
| 5,265,363 | 11/1993 | Martin | 40/605 |
| 5,267,403 | 12/1993 | Hesner . | |

FOREIGN PATENT DOCUMENTS

| | | | |
|---|---|---|---|
| 1046909 | 12/1958 | Germany . | |
| 472689 | 6/1969 | Switzerland . | |
| 2211011 | 6/1989 | United Kingdom | 40/605 |

*Primary Examiner*—Kenneth J. Dorner
*Assistant Examiner*—Cassandra Davis
*Attorney, Agent, or Firm*—Richard C. Litman

[57] ABSTRACT

A card and picture holder is formed from two identical, generally planar half portions, which are assembled together to capture a card, picture or other planar display object therebetween. Each half portion includes a transparent center window therein, so an article(s) sandwiched within the two portions may be viewed from either side. Each half portion includes a plurality of slotted channels formed in the periphery, which channels form hinge passages in the completed assembly and serve to capture the pins of interconnectors or a hanger(s) therein. The interconnectors are identical and symmetrical, and include an intermediate member which provides sufficient distance between the two opposite pins to allow for the thickness of the holders comprising an assembly of interconnected holders. Thus, the holders may be folded over one another for compact storage. The hangers have one side with a hinge pin, and an opposite side with a hanger loop or the like thereon, to allow one or more of the present holders to be suspended. Plural holders may be interconnected together to form a variety of patterns on a wall, or may be used as a room or space divider, with objects displayed therein being visible from both sides of the symmetrical assembly. The holders are preferably formed of plastic, but alternative materials (various metals, wood, etc.) may be used as desired.

20 Claims, 3 Drawing Sheets

CARD AND PICTURE HOLDER

FIELD OF THE INVENTION

The present invention relates generally to picture frames and the like, and more specifically to a versatile, modular frame assembly which may be used singly or as a plural interconnected collection of frames. Such a collection of frames may be folded together for storage, and/or assembled and displayed in a variety of configurations as desired.

BACKGROUND OF THE INVENTION

Display frames for pictures, cards or posters, etc. are commonly used for the display of such articles, to add interest to otherwise bare walls or other areas where some attractive decoration is desirable. However, in many cases, the decorative articles themselves may be relatively small, and the inclusion of multiple such articles within a single larger frame may appear somewhat cluttered. Yet, separate plural frames or holders can be difficult to align properly on a wall or other surface, and the slightest misalignment of such plural, separate frames can be obvious to the viewer.

Often, a person may wish to display a series of related articles (e.g., collector cards of a series, etc.), and separate, spaced apart frames may not indicate the relationship between the displayed articles that a single display would involve. However, it is often more attractive to display such articles separately rather than grouping them together in a single frame or display.

Accordingly, the need arises for a card and picture holder which may be used singly, or as an interconnected plurality of such holders or frames. The interconnection means should also provide for the folding of such frames or holders together for storage, as well as securing a series of such frames or holders together. The interconnecting means should be interchangeable with a hanger or hangers, to enable a collection of interconnected holders to be suspended from a wall or other surface for display. The holders or frames should be formed of identical front and rear sandwiching portions, to provide for ease of manufacture and versatility of assembly and display. Finally, each of the holders should be easily disassembleable to provide for the insertion or removal of and article therefrom, and/or the installation or removal of interconnectors and/or hangers therefrom.

DESCRIPTION OF THE PRIOR ART

U.S. Pat. No. 3,673,724 issued to Randall P. Bell et al. on Jul. 4, 1972 describes Interconnecting Picture Frames having integrally formed extensions cooperating to grasp the edges of adjoining frames. While various shapes (e. g., interconnected hexagons) are shown, the frames cannot be folded or hinged together and cannot be reversed, as provided by the present invention.

U.S. Pat. No. 4,017,989 issued to Douglas J. Murray on Apr. 19, 1977 describes Wall Frames With interlocking Clips wherein the connectors or clips comprise pins which are inserted from the back of the asymmetrical frames, into cooperating holes therein. Again, the asymmetrical nature of the frames does not provide for their reversibility, as in the present card and picture holder, and the interconnected frames cannot be hinged for folding.

U.S. Pat. No. 4,115,938 issued to Harold M. Belmuth et al. on Sep. 26, 1978 describes a Variable Picture Frame Assembly including one or more generally U-shaped clips which clamp adjacent edges of the frames of the assembly together. The clips secure to the back edges of the frames, and as such, the assembly cannot be reversed, as provided by the present invention. Moreover, the relatively rigid nature of the clips precludes any hinge function or folding together of the assembly, as provided by the present card and picture holder.

U.S. Pat. No. 4,145,827 issued to Peter G. Katsufrakis on Mar. 27, 1979 describes an Assembly For The Display Of Pictures, having a frame including slots therein to provide rabbet joints at the corners thereof. A backing sheet is frictionally inserted between opposite frame members, and the display article is adhered to the backing sheet. The result cannot be reversed, and the rabbet joints which may provide for an interconnected series of frames, do not provide any folding capability. If one of a series of frames is to be removed, the frame assembly must be disassembled and a different length(s) of framing material substituted.

U.S. Pat. No. 4,385,459 issued to John F. McGrath et al. on May 31, 1983 describes a Photo Tree formed of a plurality of frame members having slots formed therein to provide dado joints in an assembly of members. The frame members are symmetrical to provide for viewing from either side, but plural adjoining frame enclosures use at least one common frame member. Thus, if removal of a single frame is desired, the structure must be disassembled and another frame member(s) installed, as in the Katsufrakis frame discussed above. Moreover, McGrath et al. cannot be folded, and no transparent overlay to protect the display article is provided.

U.S. Pat. No. 4,608,770 issued to Robert R. Gray on Sep. 2, 1986 describes a Snap Fitting Picture Frame Collage wherein asymmetrical frame connecting means are generally formed integrally with the frame components. (It is noted that in one embodiment, a simple clip is used to secure like frame members.) No folding is provided, as the connecting means provide no hinge action. Only a single transparent side is disclosed, with the backing being an opaque sheet. Various shapes are disclosed, and it has been noted that the present invention may also accommodate differently shaped frame peripheries, but the other differences discussed above result in a frame which cannot provide the functions of the present card and picture holder construction.

U.S. Pat. No. 5,267,403 issued to Walter Hesner on Dec. 7, 1993 describes a Multiple Picture-Holder wherein the backs of the frames include a plurality of attachment means extending completely thereacross. Cooperating attachment fixtures are inserted into the attachment means as desired to connect plural frames together. As the frame backs are covered with the attachment means, an article contained in a frame cannot be viewed from either side, as provided by the symmetrical nature of the present card and picture holder. Hesner further makes no provision for hinged attachment of the frames to one another.

Swiss Patent Publication No. 472,689 to Peter Mundt et al. and published on Jun. 30, 1969 describes a picture frame comprising complementary front and back portions which apparently snap together. The portions are not identical, as with the present card and picture holder, and no means of hinged or otherwise interconnecting plural frames is disclosed by the Mundt et al. publication.

Finally, German Patent Publication No. 1,046,909 to Otto M. Barth and published on Dec. 18, 1958 describes a picture frame having complementary halves which sandwich a picture or the like therebetween. The halves are differently configured, with one half having hinge pins formed integrally therewith, and the opposite half including grooves to accept the pins of the first half. The first half pins are offset to engage the second half grooves from the back, thereby locking that edge together, with complementary latching portions securing the opposite edge of the assembly. The asymmetrical nature of the two halves, the inability of plural frame assemblies to be linked together, and the lack of hinging of plural linked frame assemblies to provide for folding, result in the Barth frame failing to provide the function or structure of the present invention.

None of the above noted patents, taken either singly or in combination, are seen to disclose the specific arrangement of concepts disclosed by the present invention.

SUMMARY OF THE INVENTION

By the present invention, an improved card and picture holder is disclosed.

Accordingly, one of the objects of the present invention is to provide an improved card and picture holder which is formed in two identical generally planar halves, which halves serve to sandwich a card, picture, or the like therebetween.

Another of the objects of the present invention is to provide an improved card and picture holder which is preferably generally rectangular, but which may alternatively be formed in any suitable geometric shape (e.g., triangles, hexagons, etc.).

Yet another of the objects of the present invention is to provide an improved card and picture holder which half portions each include a transparent center window portion therein, and a plurality of peripheral slotted channels or grooves therearound each serving to capture a frame interconnector or hanger therein.

Still another of the objects of the present invention is to provide an improved card and picture holder which frame interconnectors also serve as hinge means.

A further object of the present invention is to provide an improved card and picture holder which frame interconnectors include an intermediate member between each hinge pin, with the intermediate member adapted to provide a distance between each hinge pin which is equal to at least twice the distance between the centerline of the pin channel and the surface of the frame member, thereby accommodating the thickness of the frame members to allow them to be folded together.

An additional object of the present invention is to provide an improved card and picture holder which components may be formed of plastic, or alternatively of other suitable materials (e. g., aluminum, chromed or stainless steel, brass, wood, etc.).

A final object of the present invention is to provide an improved card and picture holder for the purposes described which is inexpensive, dependable and fully effective in accomplishing its intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout the several figures of the attached drawings.

DETAILED DESCRIPTION OF THE PREFERRED EMBODIMENT

Figure 1:
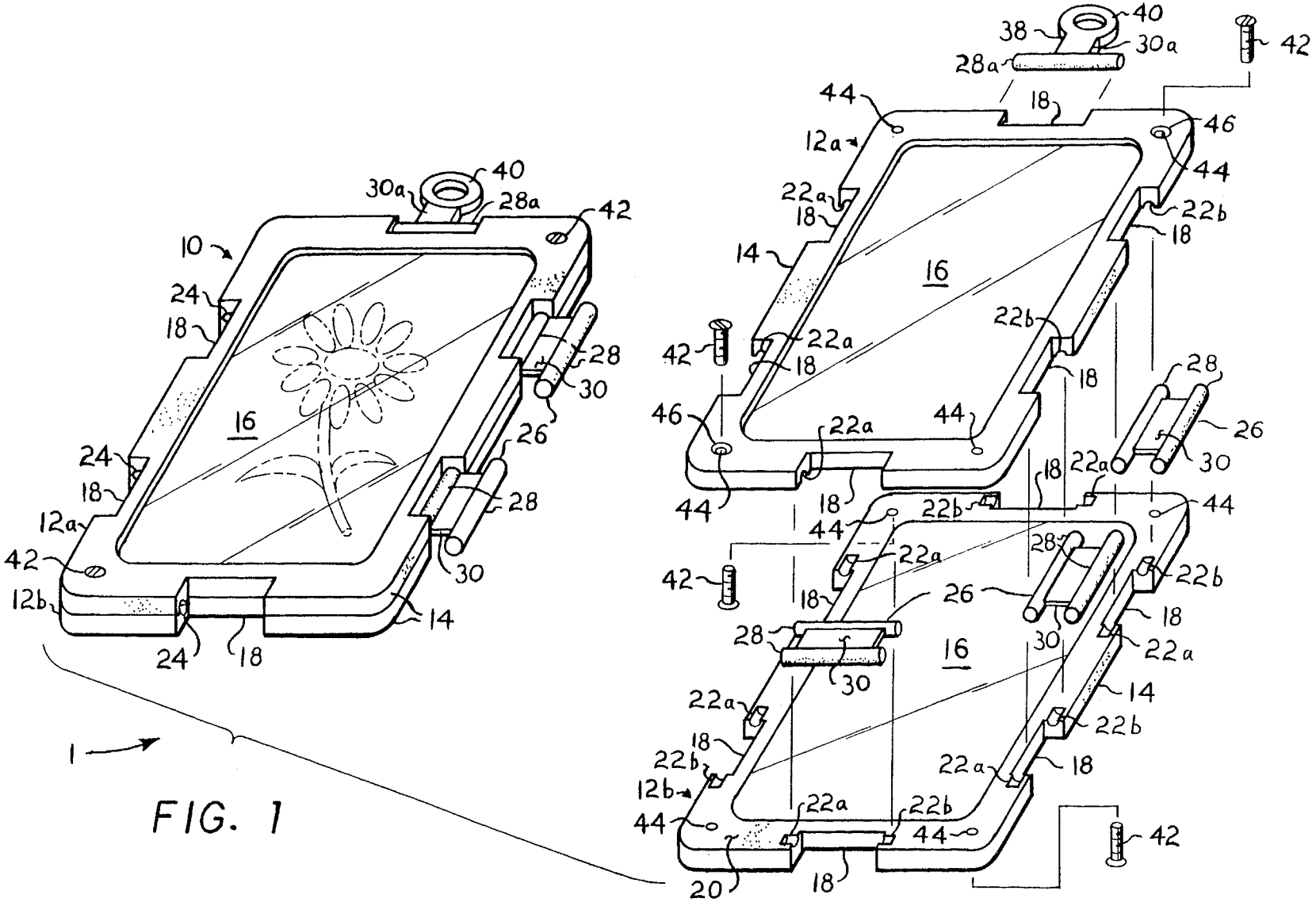
FIG. 1 is an exploded perspective view of two of the present card and picture holders, with one shown assembled and the other shown disassembled to show the installation of the interconnectors and hangers therein and the attachment of the two holders to one another.

Referring now particularly to FIG. 1 of the drawings, the present invention will be seen to relate to a card and picture holder 10, providing for the display of a card, picture, or other thin, flat article (e.g., pressed flower, ribbon, etc.) therein. The holder 10 is assembled from two identical and substantially flat, planar halves 12*a* and 12*b*, each of which generally comprises a periphery 14 surrounding a transparent window 16 therein.

Each periphery 14 includes a plurality of inset slots 18 formed therearound. The mating face 20 of each periphery 14 (i.e., the face which is in contact with the periphery of an opposite half 12*a*/12*b* when two halves 12*a*/12*b* are secured together) contains opposite and coaxial first and second channels 22*a* and 22*b* extending to each side of each of the slots 18; the channels 22*a*/22*b* are preferably semicircular in shape to allow pivotal rotation of a pin resting therein, as explained further below, and are positioned to be in registry with one another when the two halves 12*a* and 12*b* are joined together. Thus, when the two halves 12*a* and 12*b* are assembled together to form a completed single card and picture holder 10, the complementary channels 22*a*/22*b* formed in each mating face 20 of the two-peripheries 14, will define a plurality of passages 24 providing for the capture of holder interconnectors, as explained further below.

A plurality of interconnectors 26 is provided to secure plural assembled holders 10 together to form an assembly 1 thereof, as shown in FIG. 1. Each of the interconnectors 26 comprises two parallel and spaced apart pins 28 having an interconnecting member 30 extending therebetween, with each of the pins 28 being adapted to engage and to be captured within the interconnector pin capture passages 24 of one of the slots 18 when the first and second halves 12*a*/12*b* are secured together to form an assembled card and picture holder 10. Preferably, the pins 28 are cylindrical, in order to permit smooth rotation or pivoting of the pins 28 within the similarly cylindrically shaped pin passages 24. The pins 28 may have a slightly smaller diameter than the diameter of the pin passages 28, if desired, to permit free rotation of the pins 28 therein, or alternatively may be sized to provide a friction fit to resist rotation and to maintain a set position as desired. By forming the pins 28 and/or the passages 24 of a non-cylindrical shape (i. e., hexagonal, etc.), the interference between the pins 28 and passages 24 may be increased to resist free rotation and to maintain a predetermined position, if desired.

Figure 2:
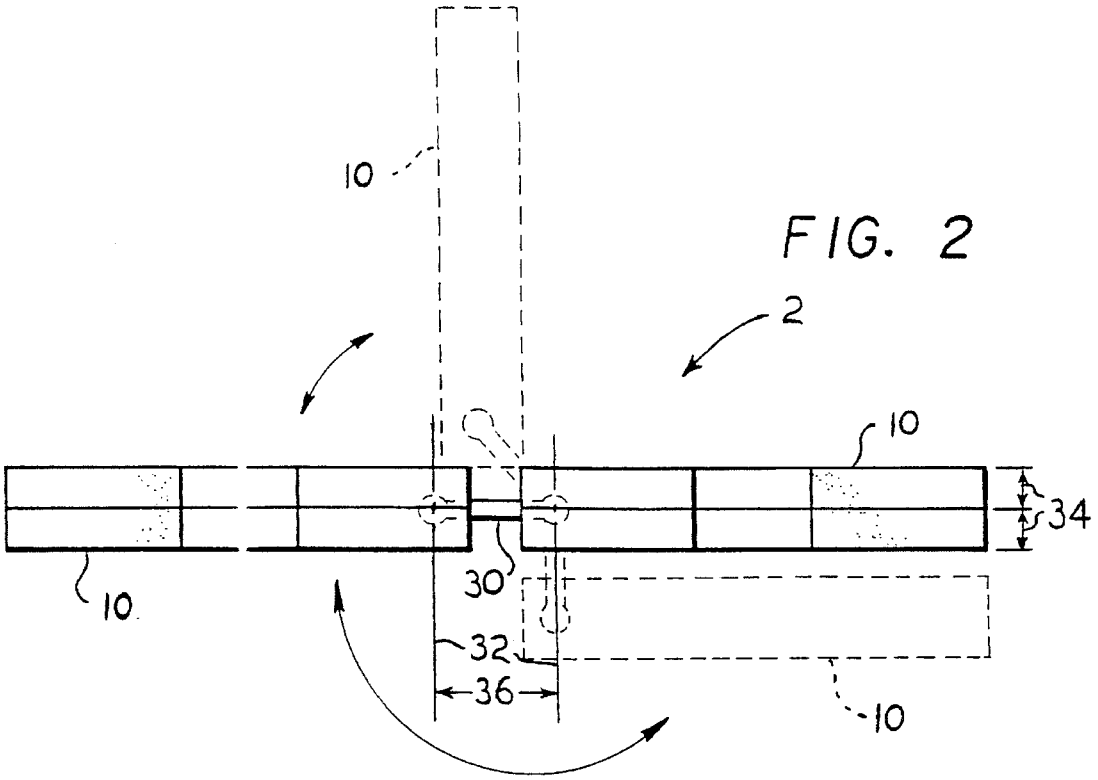
FIG. 2 is a schematic side view of a pair of card and picture holders of the present invention connected together by the interconnectors of the present invention, and showing the folding of the two holders relative to one another.
Figure 3:
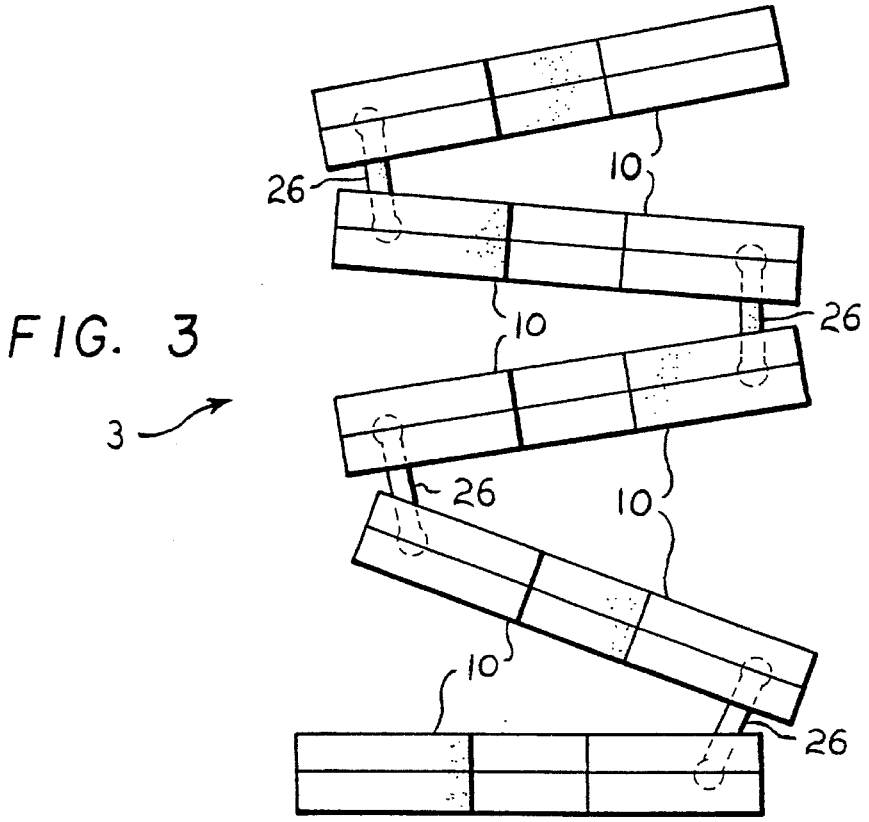
FIG. 3 is a schematic side view of a plurality of the present card and picture holders connected together along opposite lateral edges, and showing how such a plurality of holders may be folded together in an accordion fold pattern.

The present arrangement allows joined or connected card and picture holders 10 to pivot or rotate about the pins 28 of a given interconnector 26 (or parallel interconnectors 26) to allow the folding or angular displacement of one holder 10 relative to another in an assembly, as shown in the assemblies 2 and 3 respectively of FIGS. 2 and 3. In effect, the two parallel and spaced apart pins 28 of a single interconnector 26 provide two separate hinge axes 32, separated by the common interconnecting member 30 extending therebetween. The peripheries 14 of each half **12*a*/12*b* forming a completed holder 10, have a finite thickness 34 to accommodate the diameter of the interconnector pin passages 24 formed therein. By providing a distance 36 between the two pins 28 of each interconnector 26, as defined by the width of the interconnecting member 30, of at least twice the thickness 34 of each half 12*a*/12*b* (or therefore at least twice the thickness of an assembled card and picture holder 10), the thicknesses 34 of the overlying folded holder halves 12*a*/12*b* may be accommodated to provide for their complete overlayment for compact storage, if desired. Preferably, the distance or spacing between the pins 28 of each interconnector 26 is slightly greater than twice the thickness 34 of each half 12*a*/12*b*, to allow for clearance of the corners of the interconnected assembled holders 10** during folding.

FIG. 3 is a variation on the two interconnected holder panels 10 of FIG. 2, showing a total of five holders 10 interconnected at their lateral sides. The above described arrangement and configuration permits such a lateral (or longitudinal) "string" of holders 10 to be folded alternatingly over one another, in "accordion" fashion for compact storage, as shown in FIG. 3.

Returning to FIG. 1, it will be noted that a means for hanging one of the present holders 10 (or an assembly thereof) is also provided by a modified interconnector in combination with one of the peripheral slots 18 and opposite pin passages 24. The hangers 38 of FIG. 1 each include a lateral pin **28*a* which is adapted to fit within one of the pin passages 24 provided by the assembly of two halves 12*a*/12*b* together to form a completed card and picture holder 10. However, rather than having a second opposite pin, a hanger eye 40 (or alternatively, a hook, etc.) is spaced apart from the hanger pin 28*a* by an interconnecting member 30*a*, in the manner of the interconnecting member 30 of the previously discussed holder interconnectors 26. Thus, one or more hangers 38 may be assembled with the two halves 12*a*/12*b* as desired, to provide for hanging the assembled holder 10 (or an assembly thereof) from a point on a wall or other suitable area. Several hangers 38** may be used to hang a relatively large assembly.

Once the specific configuration of the holder 10 or assembly of holders 10 is determined, and the appropriate numbers of interconnectors 26 and hangers 38 are installed accordingly, the two mating halves **12*a* and 12*b* may be secured together, e.g., by means of screws 42 as shown in FIG. 1. In order to provide a smooth and attractive appearance for the holder assembly 10, the screws 42 are preferably of the flat head type, and the corresponding holes 44 in the peripheries 14 correspondingly provided with countersinks 46. It will be noted that only alternating holes 44 are countersunk, in order that the two halves 12*a*/12*b* may be formed from identical molds, dies, or tooling and may be assembled without requiring any specific matching of patterns or holes, merely by inserting the screws 42 alternately from the front or the back of the holder 10 being assembled. The threaded portions of the holes 44 may pass completely through the periphery 14 of the halves 12*a*/12*b*, as shown in the exploded halves 12*a*/12*b* of FIG. 1, or alternatively may be "blind" holes (i. e., not penetrating through the periphery 14), as shown in the assembled holder 10 to the left side of FIG. 1. Other means of securing the two holder halves 12*a* and 12*b* together (e.g., snap together fittings, etc.) may be used in lieu of screws 42**, if desired.

Figures 4A, 4B, 4C, 4D:
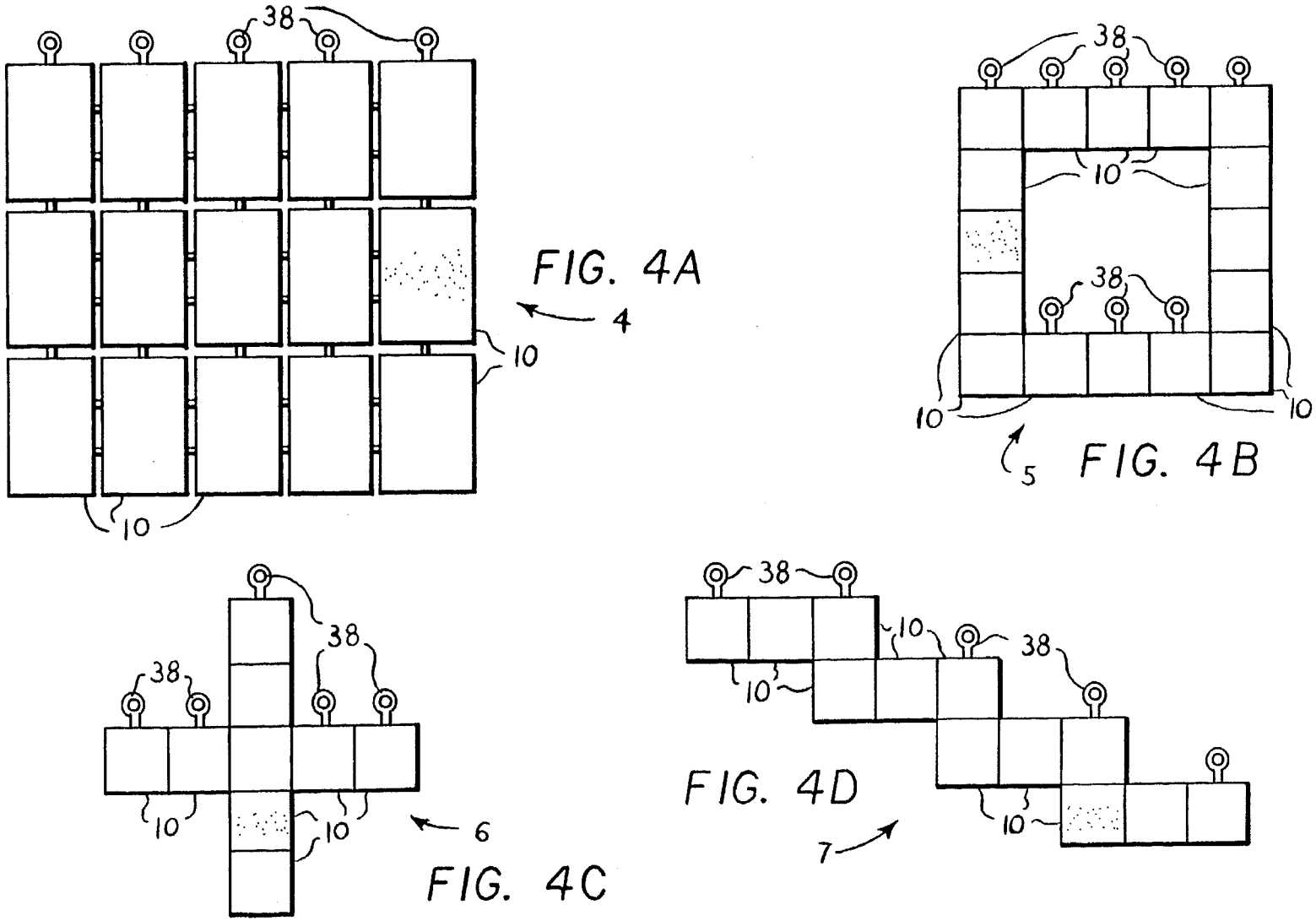
FIG. 4A is a schematic plan view of a plurality of the present card and picture holders, showing how they may be interconnected to form an essentially continuous panel assembly.
FIG. 4B is a schematic plan view of a plurality of the present card and picture holders, showing an alternative open rectangular assembly configuration.
FIG. 4C is a schematic plan view of a plurality of the present card and picture holders, showing an alternative cruciform assembly configuration.
FIG. 4D is a schematic plan view of a plurality of the present card and picture holders, showing an alternative staggered or "zig zag" assembly configuration.

The generally rectangular shape of the periphery 14 and window area 16 therein, provide for a variety of patterns to be formed from assemblies of several of the present card and picture holders 10. FIGS. 4A, 4B, 4C, and 4D disclose still further examples of possible assemblies (respectively 4, 5, 6, and 7) of the present holders 10. (It will be noted that the interconnectors have been deleted in the schematic representations of FIGS. 4B through 4D for clarity in the drawings.) In FIG. 4A, the assembly 4 forms a generally solid area of individual rectangular holders 10. Such an assembly might even be used as a room or area divider, due to the advantageous display of articles from both sides or surfaces of each of the holders 10. (The window areas of the holders represented in FIGS. 4A through 4D is not shown, due to the schematic nature of those drawing figures.) FIG. 4B is similar to FIG. 4A, but does not include any holders within the open central area. FIG. 4C discloses a cruciform shape, while figure 4D shows a "zig zag" pattern of assembled holders 10. (It will be noted that while the holder detail shown in FIG. 1 is of a rectangular holder 10, that other shapes may be used, e. g., the square holders 10 of FIGS. 4B through 4D, which comprise a special case of the general rectangular shape.) Of course, still other arrangements and assemblies may be created, limited only by the imagination of the person assembling the plurality of holders 10 as desired.

While rectangular (or square, as a special case of a rectangular shape) holders 10 have been disclosed and described in the present discussion and drawing figures, it will be noted that holders assembled using the principles and structure disclosed herein, may be made in other geometric shapes. For example, hexagonal card and picture holders may be formed if desired, with slots and interconnector attachment means on each of the six sides, to provide for assembly of a "honeycomb" pattern of plural holders. Alternatively, such holders may be formed having a triangular periphery, providing for double holder assemblies having a rhomboid or diamond shape, and further multiple assemblies formed of such double holder assemblies. Other shapes may also be formed.

Due to the capability of an assembly of the present holders 10 to be hinged or folded relative to one another, it will be seen that three dimensional shapes may also be formed. For example, if the present holders 10 are formed as squares, as shown in figures 4B through 4D, then a group of six such holders may be assembled to form a six faced polyhedron, i. e., a cube. Multiples of six may be used to form larger cubes, if desired. The inclusion of internal lighting therein would provide an attractive display. The use of holders having different peripheral shapes, as discussed further above, would lead to the construction of other more complex polyhedral shapes, e. g., dodecahedrons (12 sides), icosahedrons (20 sides), etc., depending upon the polygonal shape of the holders and the polyhedral shape desired.

The above card and picture holder or holders 10, of whatever shape, lend themselves well to molded manufacture of plastic materials. The use of plastic results in a relatively economical and yet durable construction. However, other materials may be used if desired, with the peripheral components particularly lending themselves to construction of wood or metal products to provide an attractive finish. Wood grain, brushed stainless steel, polished aluminum or brass, etc. are some of the many materials which might be used in the construction of the peripheral components of the present holders 10, as desired, and the durability of metal would also provide for its use in the manufacture of the interconnector and hanger components as well.

In summary, the present card and picture holder 10 may be used singly, for the display of a single planar article therein, or alternatively may be joined with other like holders 10 to form a plural assembly for the display of plural articles, as desired. The multiple attachment means provided about the periphery of each holder, allows such a plurality of holders 10 to be assembled in a multitude of possible configurations, as desired. As both halves comprising a single holder are of identical configuration, the transparent window area in the center of each half permits an article sandwiched therein to be viewed from either side. Thus, two cards, pictures, etc. may be inserted back to back between the opposite window portions of the holder halves, and each of the articles may be viewed respectively from each side of the assembled holder. Accordingly, an assembly of several holders may be used as a room or area divider if desired, providing an attractive display from both sides. The folding action provided by the interconnecting joint configuration of the holders, allows a plurality of holders joined in a line to be folded for compact storage, if desired. Different patterns of assemblies may be constructed, limited only by the space and number of holders available, and the imagination of the assembler. Peripheral shapes other than square may be formed, and/or various three dimensional polyhedral shapes may be constructed as desired, using the concepts of the present invention. The result of any of the above constructions is an attractive display, which will catch the eye of the viewer not only due to the display articles contained therein, but also due to the configuration of the holder assembly used for the display.

It is to be understood that the present invention is not limited to the sole embodiment described above, but encompasses any and all embodiments within the scope of the following claims.

I claim:

1. A card and picture holder, comprising:

a first half and a second half identical to said first half, with each said half having a periphery surrounding a transparent window;

each said periphery having a plurality of inset slots formed therein, with each said periphery further having a mating face with a first channel and an opposite second channel formed therein and disposed on opposite sides of each of said slots, and with said first channel and said second channel of each of said slots being coaxial and adapted to form a first and an opposite second interconnector pin capture passage on said opposite sides of each of said slots when said first half and said second half of said card and picture holder are secured together in a planar parallel relationship to form said card and picture holder, and;

a plurality of interconnectors, with each of said interconnectors including two parallel and spaced apart pins having an interconnecting member extending therebetween, with each of said pins being adapted to engage and to be captured within said first and said second interconnector pin capture passage when said first half and said second half are secured together to form said card and picture holder, whereby;

said first half and said identical second half are assembled together to form a completed said card and picture holder for the display of a planar article therein, with said interconnectors providing for the assembly of plural said card and picture holders together as desired.

2. The card and picture holder of claim 1 including:

at least one hanger, with said hanger having a pin, an opposite hanger eye spaced apart therefrom, and an interconnecting member extending therebetween, whereby;

said pin is captured within said first and said second interconnector pin capture passage, when said first half and said second half are secured together, with said hanger eye extending beyond said slot and providing for the hanging of said card and picture holder therefrom.

3. The card and picture holder of claim 1 including:

a plurality of screw holes disposed within said periphery and adapted for the installation of screws therein and providing for the assembly of one said first half with one said second half together to form said card and picture holder.

4. The card and picture holder of claim 3 wherein:

said screw holes are countersunk, thereby providing for the installation of screws therein from opposite sides of said holder.

5. The card and picture holder of claim 1 wherein:

each said pin is cylindrical in shape, and each said channel is semicylindrical to provide each said pin capture passage with a cylindrical shape, thereby providing for the pivoting of each said pin within each corresponding said pin capture passage to provide for the folding of one said card and picture holder relative to another said card and picture holder connected thereto.

6. The card and picture holder of claim 1 wherein:

each said half has a thickness, and each said interconnecting member of each of said interconnectors has a width sufficient to separate said two parallel and spaced apart pins of each of said interconnectors by a distance equal to at least twice said thickness of each said half, thereby providing for the folding of one said card and picture holder over another said card and picture holder connected thereto.

7. The card and picture holder of claim 1 wherein:

each said half and each of said interconnectors is formed of plastic.

8. The card and picture holder of claim 1 wherein:

at least said periphery of each said half and each of said interconnectors is formed of metal.

9. The card and picture holder of claim 1 wherein:

at least said periphery of each said half is formed of wood.

10. The card and picture holder of claim 1 wherein:

said card and picture holder has a generally rectangular periphery, with a generally rectangular window therein.

11. A card and picture holder assembly, comprising:

a plurality of card and picture holders each formed of a first half and a second half identical to said first half, with each said half having a periphery surrounding a transparent window;

each said periphery of each said half having a plurality of inset slots formed therein, with each said periphery further having a mating face with a first channel and an opposite second channel formed therein and disposed on opposite sides of each of said slots, and with said first channel and said second channel of each of said slots being coaxial and adapted to form a first and an opposite second interconnector pin capture passage on said opposite sides of each of said slots when said first half and said second half of each of said card and picture holders are respectively secured together in a planar parallel relationship to form one of said card and picture holders;

a plurality of interconnectors, with each of said interconnectors including two parallel and spaced apart pins having an interconnecting member extending therebetween, with each of said pins being adapted to engage and to be captured within said first and said second interconnector pin capture passage when said first half and said second half are secured together to form one of said card and picture holders, and;

one or said card and picture holders is connected to at least one other of said card and picture holders by means of at least one of said interconnectors to form said card and picture holder assembly for the display of plural articles.

12. The card and picture holder assembly of claim 11 including:

at least one hanger, with said hanger having a pin, an opposite hanger eye spaced apart therefrom, and an interconnecting member extending therebetween, whereby;

said pin is captured within said first and said second interconnector pin capture passage of one of said card and picture holders, with said hanger eye extending beyond said one of said slots and providing for the hanging of said one of said card and picture holders therefrom.

13. The card and picture holder assembly of claim 11 including:

a plurality of screw holes disposed within said periphery of each of said card and picture holders and adapted for the installation of screws therein and providing for the assembly of one said first half with one said second half together to form one of said card and picture holders.

14. The card and picture holder assembly of claim 13 wherein:

said screw holes are countersunk, thereby providing for the installation of screws therein from opposite sides of each of said card and picture holders.

15. The card and picture holder assembly of claim 11 wherein:

each said pin is cylindrical in shape, and each said channel is semicylindrical to form each said pin capture passage to have a cylindrical shape, thereby providing for the pivoting of each said pin within each corresponding said pin capture passage to provide for the folding of said card and picture holders of said assembly relative to one another.

16. The card and picture holder assembly of claim 11 wherein:

each said half has a thickness, and each said interconnecting member of each of said interconnectors has a width sufficient to separate said two parallel and spaced apart pins of each of said interconnectors by a distance equal to at least twice said thickness of each said half, thereby providing for the folding of one of said card and picture holders over another of said card and picture holders of said card and picture holder assembly.

17. The card and picture holder assembly of claim 11 wherein:

each said half and each of said interconnectors is formed of plastic.

18. The card and picture holder assembly of claim 11 wherein:

at least said periphery of each said half and each of said interconnectors is formed of metal.

19. The card and picture holder assembly of claim 11 wherein:

at least said periphery of each said half is formed of wood.

20. The card and picture holder assembly of claim 11 wherein:

each of said card and picture holders has a generally rectangular periphery, with a generally rectangular window therein.

* * * * *